US006394168B1

(12) United States Patent
Zoboski

(10) Patent No.: US 6,394,168 B1
(45) Date of Patent: May 28, 2002

(54) SHOWER CURTAIN ASSEMBLY

(76) Inventor: Jayne A. Zoboski, 13852 Petersburg Dr., Plainfield, IL (US) 60544

( * ) Notice: Subject to any disclaimer, the term of this patent is extended or adjusted under 35 U.S.C. 154(b) by 0 days.

(21) Appl. No.: 09/772,806

(22) Filed: Jan. 30, 2001

(51) Int. Cl.[7] ..... A47H 1/00

(52) U.S. Cl. ..... 160/123; 160/DIG. 6; 160/DIG. 18; 24/429; 24/716

(58) Field of Search ..... 160/123, 124, 160/126, 330, 237, DIG. 6, DIG. 18; 4/558, 608; 24/429, 399, 400, 716

(56) References Cited

U.S. PATENT DOCUMENTS

| | | | | | |
|---|---|---|---|---|---|
| 2,764,793 | A | * | 10/1956 | Sander | 24/429 X |
| 2,777,181 | A | * | 1/1957 | Morner | 24/429 X |
| 2,794,227 | A | * | 6/1957 | Dorman | 24/429 X |
| 3,035,275 | A | * | 5/1962 | Strebeigh | 160/237 X |
| 3,321,003 | A | * | 5/1967 | Boerner | 160/237 X |
| 3,579,747 | A | * | 5/1971 | Hawley | 24/429 X |
| 5,007,143 | A | | 4/1991 | Herrington | |
| 5,191,922 | A | * | 3/1993 | Wade | 160/124 |
| 5,289,602 | A | | 3/1994 | Trader | |
| 5,544,387 | A | | 8/1996 | Yamamoto et al. | |
| 5,586,595 | A | | 12/1996 | Takizawa et al. | |
| 5,636,415 | A | * | 6/1997 | James | 24/399 |
| 5,651,407 | A | | 7/1997 | Perez | |
| 5,894,642 | A | | 4/1999 | Eberhardt | |
| 5,894,876 | A | * | 4/1999 | O'Brien | 160/124 X |
| 5,950,255 | A | * | 9/1999 | Thompson | 160/DIG. 6 X |
| 5,974,603 | A | * | 11/1999 | Frazier | 4/558 X |
| 6,038,749 | A | | 3/2000 | Eberhardt | |
| 6,041,454 | A | | 3/2000 | Summerford | |
| 6,163,899 | A | * | 12/2000 | Leonard | 160/DIG. 6 X |
| 6,192,965 | B1 | * | 2/2001 | Hinds | 160/DIG. 6 X |

* cited by examiner

*Primary Examiner*—David M. Purol
(74) *Attorney, Agent, or Firm*—Dale J. Ream

(57) ABSTRACT

A shower curtain assembly for easy mounting or dismounting relative to a shower rod includes a first shower curtain portion having short vertical side edges with top and bottom edges extending therebetween and defining apertures for hanging the first portion from a shower rod with hooks. A second shower curtain portion includes long vertical side edges with top and bottom edges extending therebetween. Fastener strips having rib and groove elements depend from bottom and top edges of the first and second portions, respectively. Each fastener defines a guide track. The assembly includes a slider formed to straddle the fastener strips and having guide members that cooperate with the guide tracks. A separator finger is disposed in the slider and is shaped so as to urge the rib and groove elements apart or together depending on which longitudinal direction the slider is moved.

7 Claims, 6 Drawing Sheets

SHOWER CURTAIN ASSEMBLY

BACKGROUND OF THE INVENTION

This invention relates generally to shower curtains and, more particularly, to a shower curtain assembly that is quick and easy to mount to or dismount from a shower rod for cleaning or replacement.

Shower curtains are commonly used to minimize the overspray of water from a shower into a bathroom area. However, the inner surfaces of shower curtains are repeatedly exposed to soap, shampoo, and the like, making it desirable to periodically remove the shower curtain for cleaning. Removal of a shower curtain typically requires a user to undertake the inconvenient task of unhooking the upper edge of the curtain from a plurality of S-hooks or other fasteners cooperating with the shower rod.

Various shower curtains having means for improved attachment and removal relative to a shower rod have been proposed in the art such as those that use hook and loop straps or strips to hang a curtain from a rod. Existing assemblies, however, require a user to properly align a long hook and loop strip or to manipulate multiple hook and loop straps. These and other similar assemblies are both inconvenient and time consuming.

Therefore, it is desirable to have a shower curtain assembly that is easily mountable to a shower rod with only a single alignment of fasteners. Further, it is desirable to have a shower curtain assembly that may be attached or removed with an easy fluid motion of a user's arm.

SUMMARY OF THE INVENTION

A shower curtain assembly according to the present invention includes a two-part shower curtain sheet. A first portion is a flexible, rectangular, planar sheet having short vertical side edges with top and bottom edges extending longitudinally therebetween. The first portion of the shower curtain defines a plurality of apertures spaced apart along the top edge thereof. Therefore, the first portion may be removably mounted to a shower rod with a plurality of shower curtain rings which respectively couple the rod and apertures. The first portion extends only a small distance below the rod. A second portion of the shower curtain sheet is a flexible, rectangular, planar sheet having long vertical edges with top and bottom edges extending longitudinally therebetween. The top edge of the second portion is removably coupled to the bottom edge of the first portion. When coupled, the side edges of the second portion are of a length such that the bottom edge extends below the top of a bathtub wall.

The bottom and top edges of the first and second portions, respectively, are coupled together with a flexible zipper. The zipper includes a flexible plastic fastener strip depending from the bottom edge of the first shower curtain portion and another fastener strip depending from the top edge of the second shower curtain portion. The fastener strips include respective interlocking rib and groove profile elements that are configured to mate when pressed together. The zipper further includes a slider formed to straddle the fastener strips and having guide members for cooperating with profiled guide tracks formed in the fastener strips. A separator finger is disposed within the slider and is configured to urge the rib and groove elements apart when the slider is moved in one direction and to urge them into a mating relationship when the slider is moved in an opposite direction. Therefore, the second shower curtain portion may be attached to or removed from the first portion by sliding the slider in one direction or the other. Alignment of the edges to be coupled with the zipper is automatic so that continuous or repetitive alignment maneuvers by a user are unnecessary.

Therefore, a general object of this invention is to provide a shower curtain assembly that separates easily into two portions for easy attachment to or removal from a shower rod.

Another object of this invention is to provide a shower curtain assembly, as aforesaid, which selectively couples upper and lower shower curtain portions with a zipper.

Still another object of this invention is to provide a shower curtain assembly, as aforesaid, in which upper and lower portions of a shower curtain are attached or detached when fastener strips having rib and groove profile elements are pressed together or separated upon movement of a slider.

Yet another object of this invention is to provide a shower curtain assembly, as aforesaid, in which upper and lower portions of a shower curtain may be coupled in a watertight configuration without any water/metal reaction.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

Figure 1:
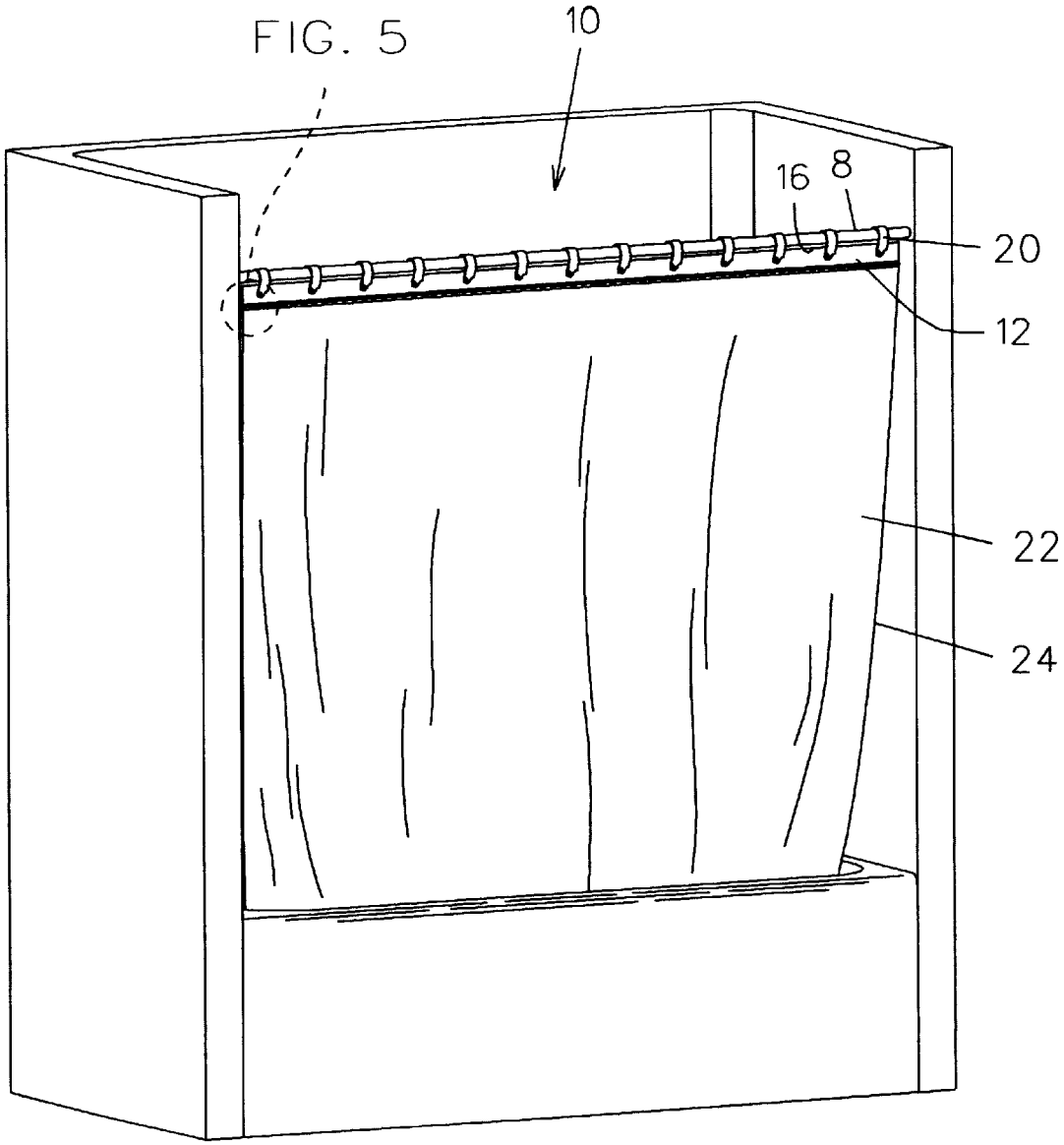
FIG. 1 is a perspective view of shower curtain assembly according to one embodiment of the present invention with upper and lower shower curtain portions in a coupled configuration.
Figure 2:
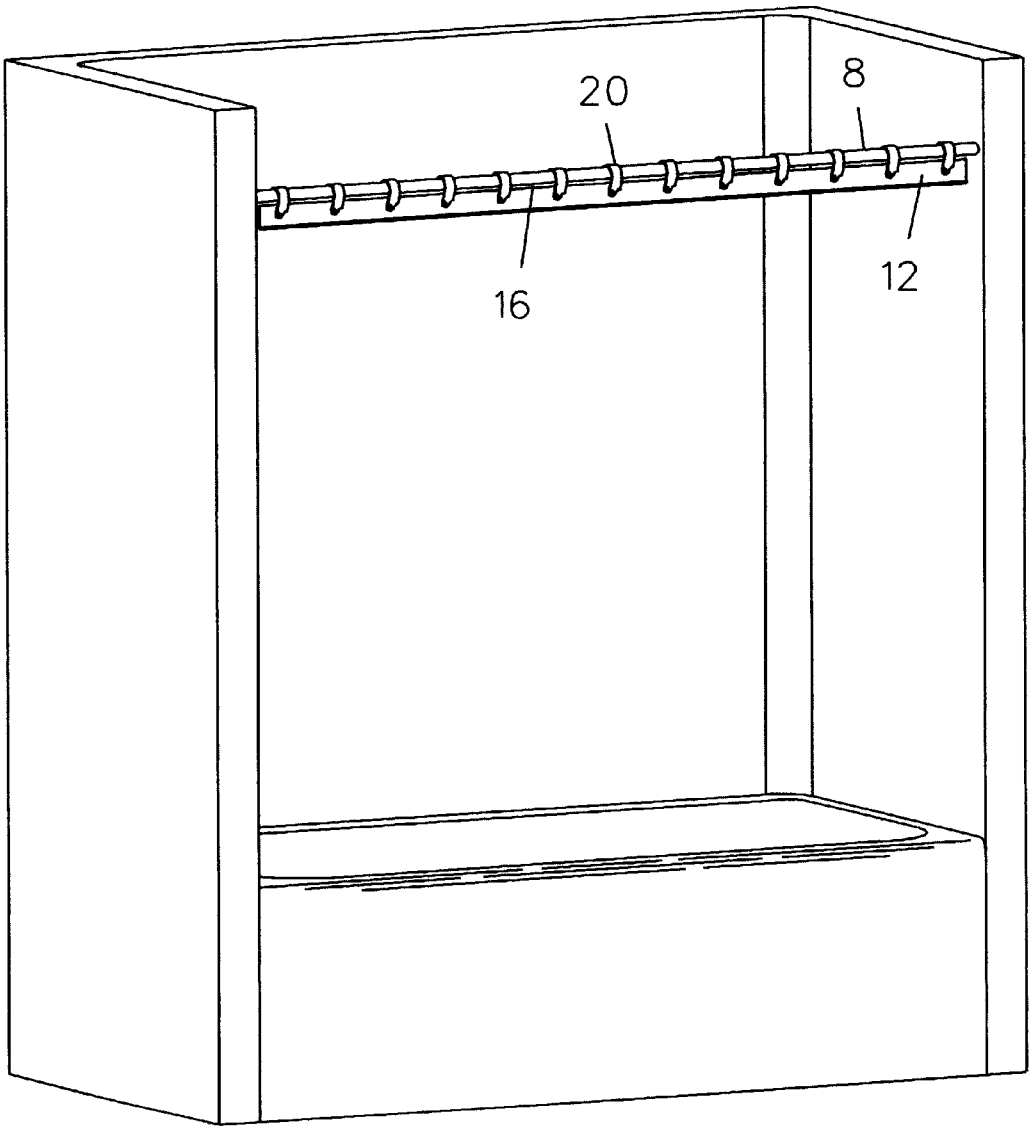
FIG. 2 is a perspective view of a shower curtain assembly as in FIG. 1 with the lower portion detached from the upper portion.

A shower curtain assembly according to the present invention will now be described with reference to FIGS. 1–6 of the accompanying drawings.

A shower curtain assembly 10 according to one embodiment of the invention includes a two-part flexible plastic shower curtain having a first upper portion 12 and a second lower portion 22. The upper 12 and lower 22 portions may be coupled together and hung from a shower rod 8 (FIG. 1) or the lower portion 22 may be detached from the first portion (FIG. 2), as to be described more fully below. The upper portion 12 of the shower curtain is a flexible, planar sheet having a rectangular configuration that includes short opposed side edges 14 with top 16 and bottom edges extending longitudinally therebetween. The upper portion 12 defines a plurality of apertures 18 equidistantly spaced apart along the top edge 16 thereof. The shower curtain assembly 10 includes a plurality of shower curtain rings 20 or S-hooks, each hook having one end configured to extend through an aperture 18 and an opposed end configured to releasably hang from a shower rod 8. Therefore, the upper portion 12 may be removably coupled to a shower rod 8 with the rings 20 or other suitable fasteners. As the side edges 14 of the upper portion 12 have a short length dimension, the bottom edge thereof extends only a small distance below the shower rod 8 when coupled thereto.

The lower portion 22 of the shower curtain is a flexible planar sheet having long side edges 24 with top and bottom edges extending longitudinally therebetween. The side edges 24 are of a length such that the bottom edge of the upper portion 12 extends into the tub of a shower assembly when the upper 12 and lower 22 portions are coupled together (FIG. 1), as to be described more fully below.

Figure 4:
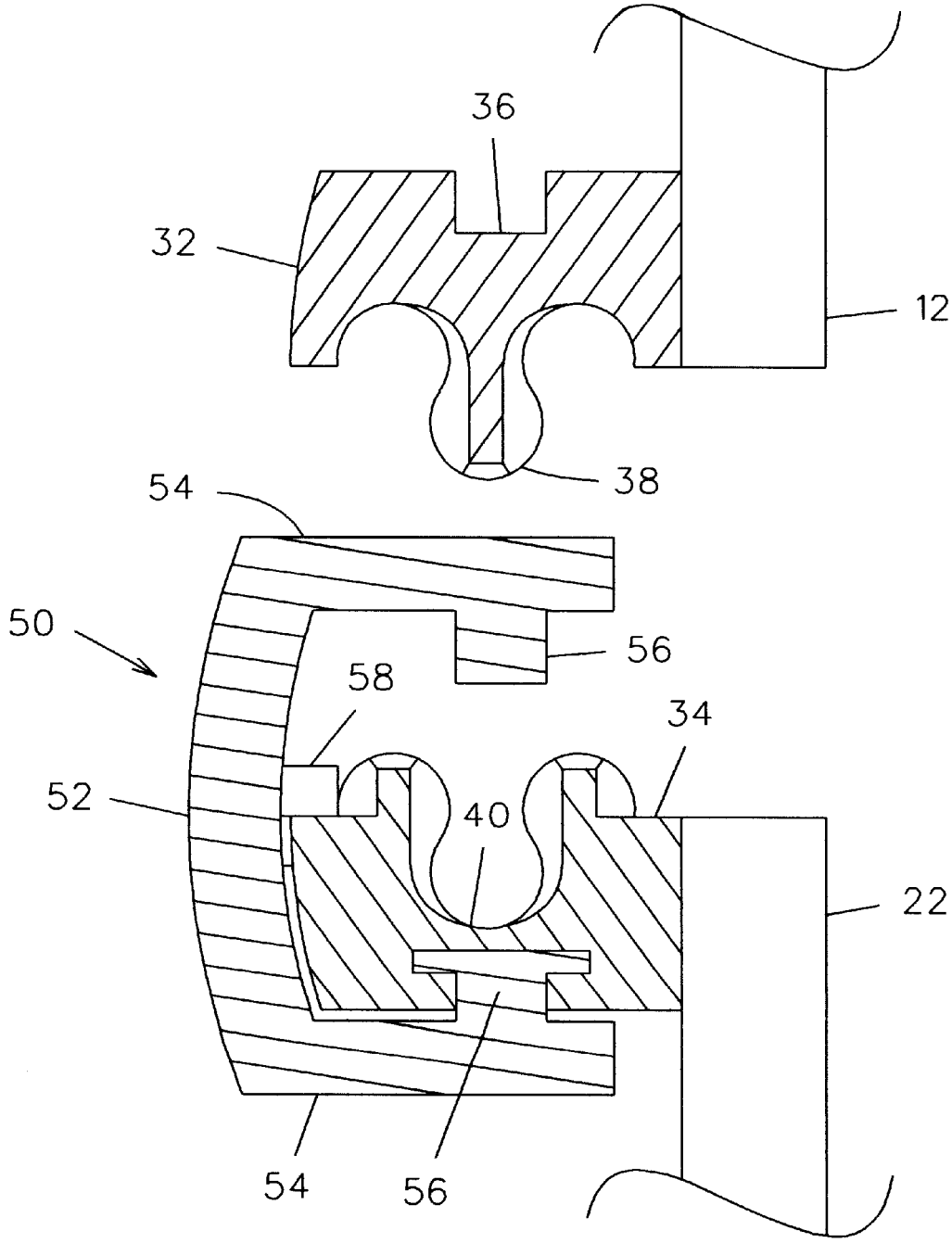
FIG. 4 is a sectional view taken along line 4—4 of FIG. 3.
Figure 5:
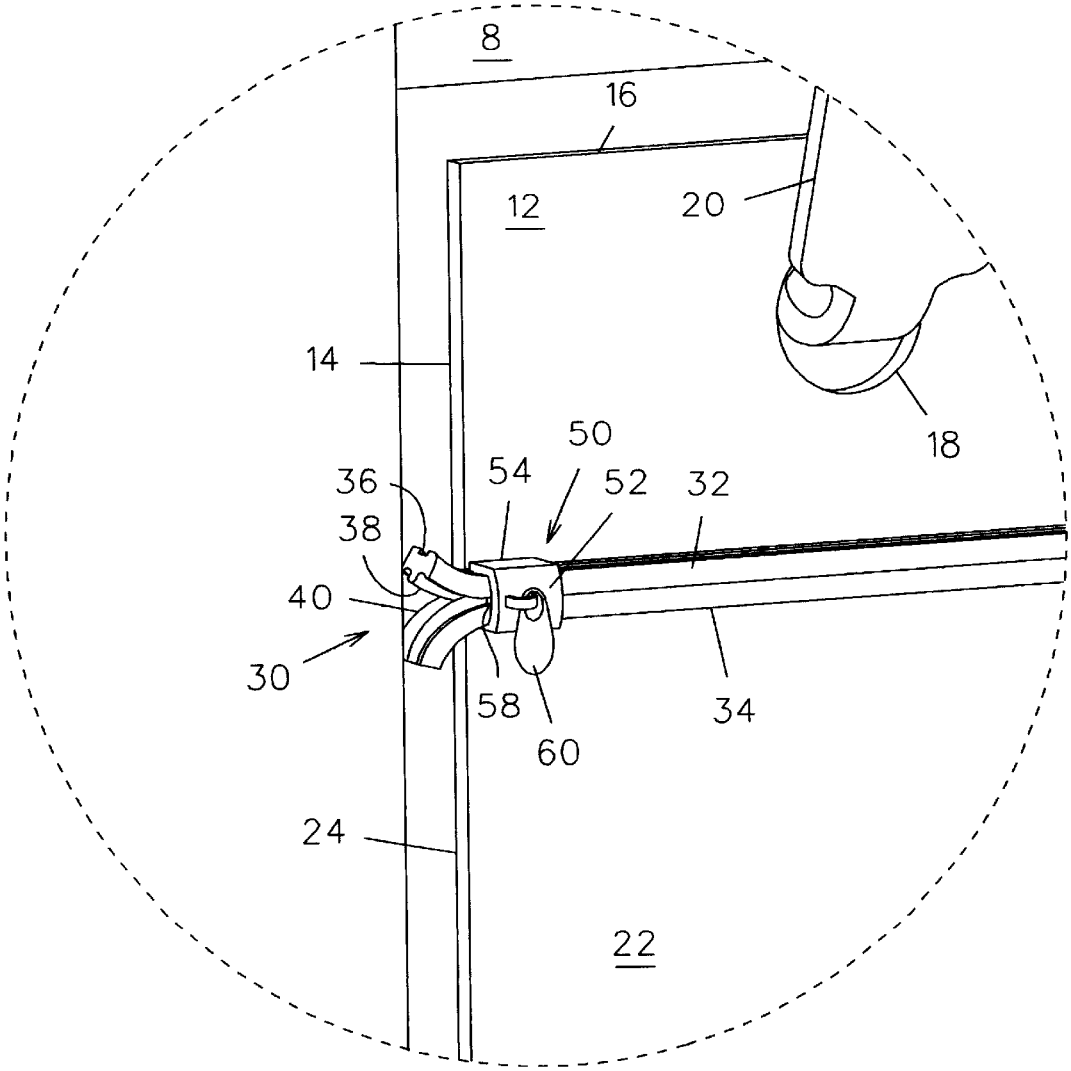
FIG. 5 is a perspective view on an enlarged scale of the zipper as in FIG. 1.

The bottom edge of the upper portion 12 may be releasably coupled to the top edge of the lower portion 22 with a flexible zipper 30. The zipper 30 includes one flexible plastic fastener strip 32 depending from the bottom edge of the upper portion 12 and another flexible fastener strip 34 depending from the top edge of the lower portion 22. The fastener strips 32, 34 include interlocking rib 38 and groove 40 profile elements, respectively, that are configured to mate with one another when urged or pressed together with a slider 50 (FIGS. 4 and 5). Of course, the rib and groove elements could be inverted relative to one another so long as they remain configured to mate with one another. Each fastener strip 32, 34 further defines a profiled guide track 36 extending parallel to respective rib 38 and groove 40 elements.

Figure 3:
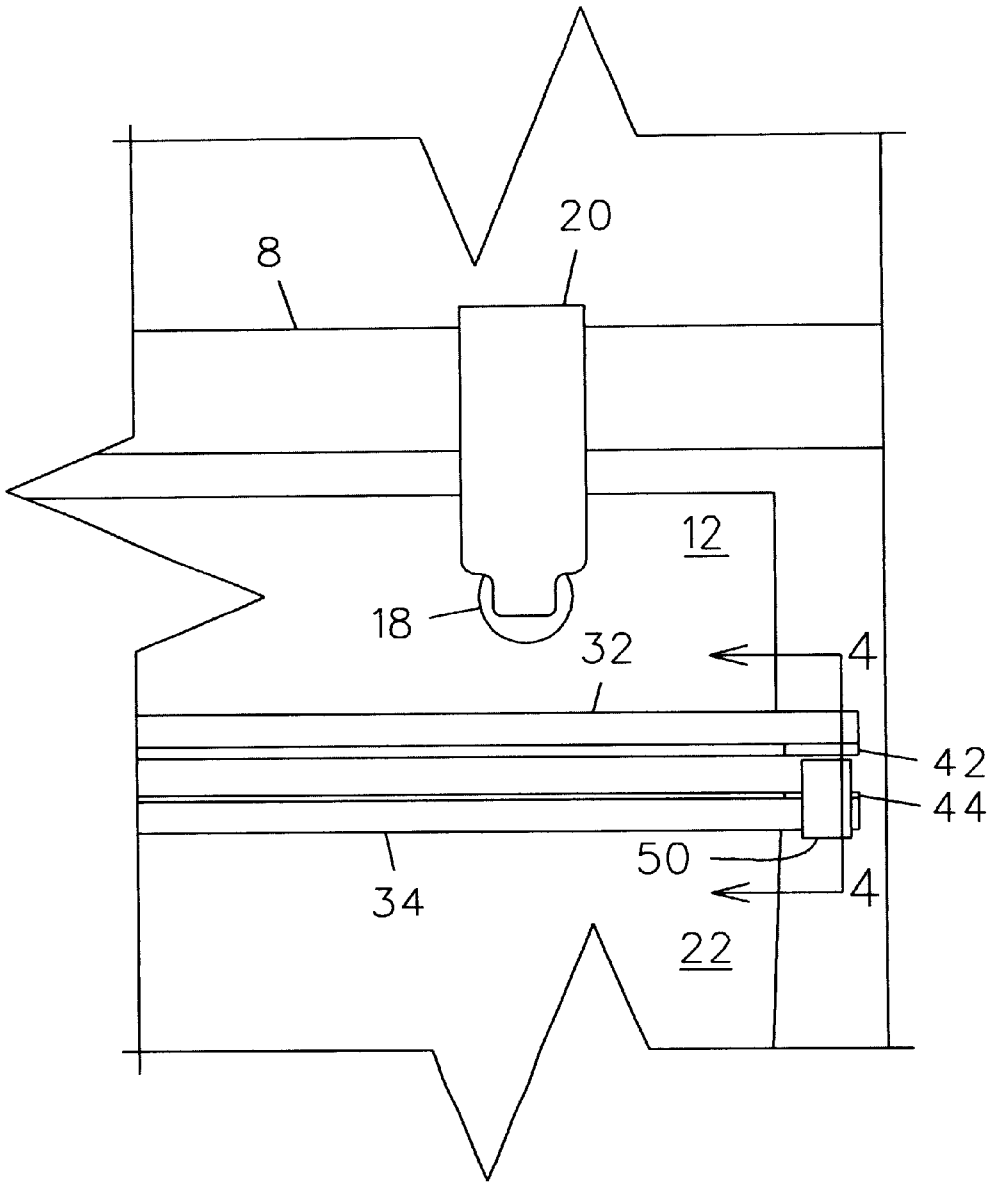
FIG. 3 is a fragmentary view on an enlarged scale of a shower curtain assembly with the lower portion in a detached configuration and configured for attachment.

The zipper 30 further includes an inverted U-shaped slider 50 having a back wall 52 and a pair of side walls 54 depending therefrom (FIG. 4). The slider 50, therefore, has open ends and an open front. The slider 50 includes a pair of guide members 56 fixedly attached to inner surfaces of opposed side walls 54 with each guide member having a configuration that cooperates with a respective guide tracks 36. It is understood that both guide tracks 36 and both guide members 56 need not have identical configurations and may have configurations other than those illustrated in the accompanying drawings. Therefore, the slider 50 is configured to straddle the fastener strips 32, 34 such that the guide members 56 cooperate with the guide tracks 36 for sliding along top edges of the fastener strips 32, 34. As with a conventional zipper, each fastener strip 32, 34 includes a starter element 42, 44 for initial insertion in the slider 50 (FIG. 3).

A separator finger 58 is fixedly attached to the inner surface of the back wall 52 between the side walls 54 thereof and has a variable-width configuration for urging the rib 38 and groove 40 elements together when the slider 50 is moved in a closing direction and urging the rib 38 and groove 40 elements apart when the slider 50 is moved in an opening direction. In other words, the changing width of the separator finger 58, which is disposed between the strips, either allows the guide members 56 to force the rib 38 and groove 40 elements together or to separate them depending on the direction of slider movement. A pull tab 60 is pivotally coupled to the back wall 52 of the slider 50 so that a user may easily pull the slider 50 in either a closing or opening direction (FIG. 5).

In use, a user may couple the upper portion 12 of the shower curtain to a shower rod 8 with shower curtain rings 20. If the lower portion 22 of the shower curtain is connected to the upper portion 12, a user may detach the lower portion 22 therefrom, i.e. for cleaning or replacement, by slidably moving the slider 50 in an opening direction. As the fastener strips 32, 34 pass through the slider 50 via cooperation between the guide tracks 36 and guide members 56, the rib 38 and groove 40 elements are urged apart by the separator finger 58 within the slider 50. To reattach the lower portion 22 to the upper portion 12, a user may insert the fastener strip starter elements 42, 44 into the slider 50 and move the slider 50 in a closing direction. As the fastener strips pass through the slider 50 via cooperation between guide members 56 and guide tracks 36, the rib 38 and groove 40 elements are urged together in an interlocking relationship by the configuration of the separator finger 58 and inner surfaces of the slider 50. No other alignments or manipulations are needed. When the slider 50 is completely moved in the closing direction, the zipper 30 provides a watertight seal between upper 12 and lower 22 portions. In addition, the flexible plastic zipper 30 is easy to use and unsusceptible to rust.

Figure 6:
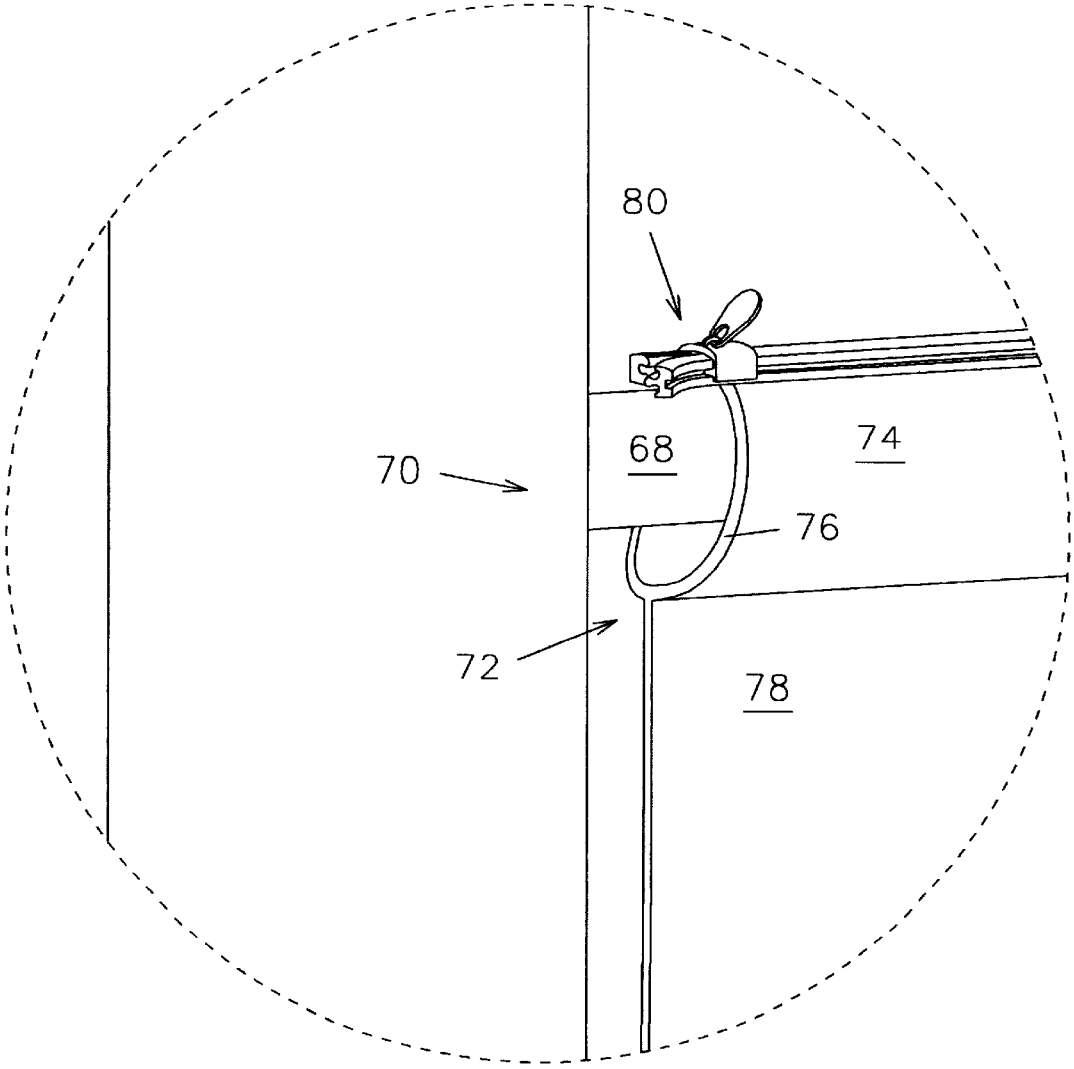
FIG. 6 is a perspective view as in FIG. 5 according to another embodiment of the invention.

Another embodiment of the shower curtain assembly 70 is shown in FIG. 6 and is substantially similar in construction to the assembly described above except as particularly noted below. The shower curtain 72 in this embodiment is of a unitary construction. More particularly, the shower curtain 72 includes a flexible plastic coupling member 74 integral with a flexible, rectangular, plastic shower curtain sheet 78. The coupling member 74 includes side edges 76 with top and bottom edges extending longitudinally therebetween. The side edges 76 are of a sufficient length such that the coupling member 74 may be wrapped around a shower rod 68 and the top and bottom edges coupled together with a zipper 80. The shower curtain sheet 78 is attached to the coupling member 74 preferably at a midpoint between the top and bottom edges of the coupling member 74 so that the zipper 80 is positioned on top of the shower rod 68 and the curtain sheet 78 hangs properly below the rod. The zipper 80 includes a construction substantially similar to that described previously. It should be appreciated that a conventional metal zipper could be used with the present invention although it may not provide the watertight seal of the construction described herein and may have an adverse reaction to water (e.g. rust) unless covered by protective flaps.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A shower curtain assembly for easy mounting and dismounting to a shower rod, comprising:

a first rectangular planar shower curtain sheet having short vertical side edges with straight top and bottom edges extending therebetween, said first shower curtain sheet defining a plurality of apertures spaced along said top edge;

a plurality of shower curtain fasteners adapted to hang from a rod, each hook passing through a respective aperture;

a second rectangular planar shower curtain sheet having long vertical side edges with straight top and bottom edges extending therebetween;

a first flexible plastic fastener strip depending from said bottom edge of said first shower curtain sheet and a second flexible plastic fastener strip depending from said top edge of said second shower curtain sheet, said first and second fastener strips including interlocking rib and groove profile elements extending longitudinally along respective fastener strips and having complementary configurations such that said rib and groove elements are closed in a mating relationship when said rib and groove elements are pressed together;

wherein each fastener strip defines a profiled guide track along the length thereof parallel to a respective rib or groove element;

a slider for straddling said first and second fastener strips and adapted to move slidably therealong, said slider having a separator finger configured so as to open or close said rib and groove elements of said first and second fastener strips upon movement of said slider;

wherein said slider includes opposed guide members adapted to cooperate with said guide tracks for directing said fastener strips into engagement with said separator finger for opening or closing said rib and groove elements thereof; and wherein said slider includes an inverted U-shaped plastic member having a back wall for moving along top edges of said fastener strips and opposed end walls depending from said back wall, said guide members being attached to said end walls for cooperating with said guide tracks, said separator finger depending from said back wall between said, side walls for insertion between said fastener strips.

2. The shower curtain assembly as in claim 1 wherein said separator finger is shaped so as to urge said rib and groove elements apart when the slider is moved in one direction and to urge said rib and, groove elements together when said slider is moved in an opposite direction.

3. The shower curtain assembly as in claim 1 wherein said apertures of said first shower curtain sheet are equidistantly spaced apart along said top edge thereof.

4. The shower curtain assembly as in claim 1 wherein said rib and groove elements form a waterproof seal between said first and second shower curtain sheets when pressed together.

5. A shower curtain assembly for easy mounting and dismounting relative to a shower rod, comprising:

a rectangular planar shower curtain sheet, comprising:

an upper portion having short vertical side edges with straight top and bottom edges extending therebetween, said first portion defining a plurality of equidistantly spaced apart apertures along said top edge;

a lower portion having long vertical side edges with straight top and bottom edges extending therebetween;

a plurality of shower curtain fasteners adapted to hang from a shower rod, each hook passing through a respective aperture of said upper portion; and means for releasably coupling said bottom edge of said upper portion and said top edge of said lower portion together so as to form a waterproof seal therebetween, said coupling means comprising:

a first flexible plastic fastener strip depending from said bottom edge of said upper portion of said shower curtain and a second flexible plastic fastener strip depending from said top edge of said lower portion of said shower curtain, said first and second fastener strips including interlocking rib and groove profile elements extending longitudinally along respective fastener strips and having complementary configurations such that said rib and groove elements are closed in a mating relationship when said rib and groove elements are pressed together;

a slider for straddling said first and second fastener strips and adapted to move slidably therealong, said slider having a separator finger configured so as to open or close said rib and groove elements of said first and second fastener strips upon movement of said slider;

wherein each fastener strip defines a profiled guide track along the length thereof parallel to a respective rib or groove element;

wherein said slider includes opposed guide members adapted to cooperate with said guide tracks for directing said fastener strips into engagement with said separator finger for opening or closing said rib and groove elements thereof; and wherein said slider includes an inverted U-shaped plastic member having a back wall for moving along top edges of said fastener strips and opposed end walls depending from said back wall, said guide members being attached to said end walls for cooperating with said guide tracks and said separator finger depending from said back wall between said side walls for insertion between said fastener strips.

6. The shower curtain assembly as in claim 5 wherein said coupling means includes a zipper.

7. The shower curtain assembly as in claim 5 wherein said separator finger is shaped so as to urge said rib and groove elements apart when the slider is moved in one direction and to urge said rib and groove elements together when said slider is moved in an opposite direction.

* * * * *